United States Patent [19]

Selig

[11] 4,215,338

[45] Jul. 29, 1980

[54] MODULE FOR PRESENTING ALPHA NUMERIC INFORMATION

[76] Inventor: Guenther Selig, 2138 Rugen Rd., Glenview, Ill. 60025

[21] Appl. No.: 11,203

[22] Filed: Feb. 12, 1979

Related U.S. Application Data

[63] Continuation of Ser. No. 806,999, Jun. 16, 1977.

[51] Int. Cl.[2] ..... G08B 5/26

[52] U.S. Cl. ..... 340/373; 340/378.1

[58] Field of Search ..... 340/373, 366 R, 366 B, 340/378 R

[56] References Cited

U.S. PATENT DOCUMENTS 3,518,664 1/1970 Taylor ..... 340/373

*Primary Examiner*—Harold I. Pitts

*Attorney, Agent, or Firm*—Tilton, Fallon, Lungmus & Chestnut

[57] ABSTRACT

A module for presenting alpha-numeric information includes a plurality of shutter elements mounted on a module frame and arranged in rows and columns. Each shutter has a permanent magnet whose field is selectively opposed by an electromagnet mounted on the frame for pivoting each shutter.

3 Claims, 5 Drawing Figures

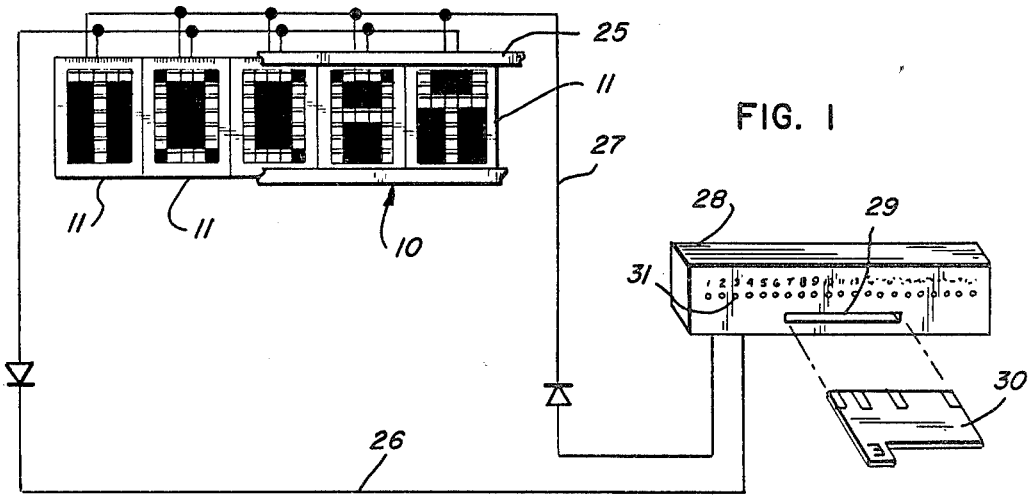
FIG. 1
FIG. 2
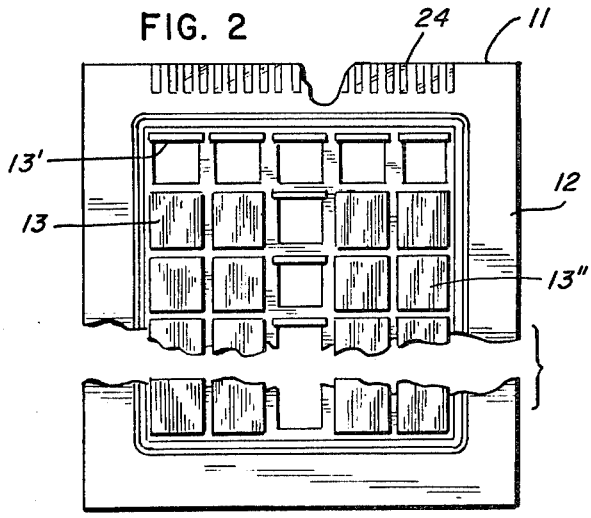
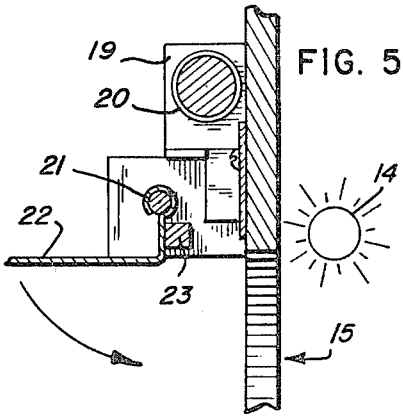
FIG. 5
FIG. 3
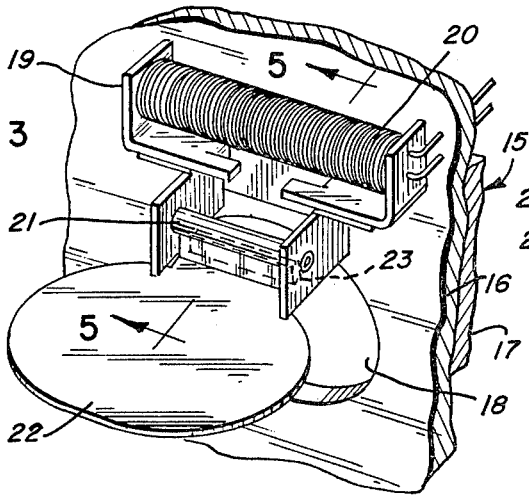
FIG. 4
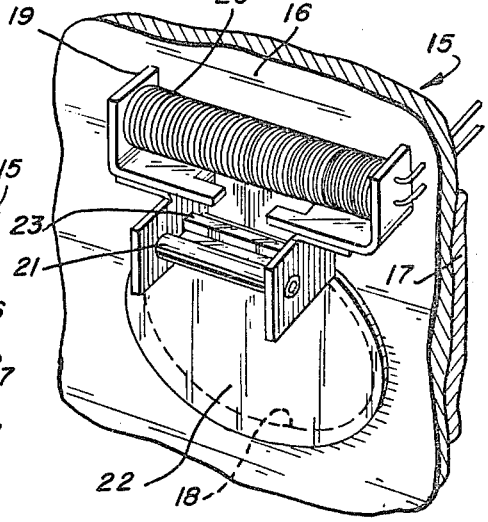

MODULE FOR PRESENTING ALPHA NUMERIC INFORMATION

This is a continuation of application Ser. No. 806,999 6/16/77.

BACKGROUND AND SUMMARY OF INVENTION

This invention relates to a module for presenting alpha-numeric information and more particularly, relates to a simple, reliable structure suitable for replacement of hand installed alpha-numeric characters.

In one preferred instance, the invention finds utility in connection with marquees. For the most part, these are large assemblies which accommodate a number of letters or numbers which are usually hand installed—thus, not only taking considerable time but also possibly endangering the artisan doing the work. Although electronic message signs have been used extensively, most marquee installations cannot justify the expense of such sophisticated image providing devices. Also, many of the installations are serviced by relatively untrained personnel so that a rugged mechanical device is indicated, not sophisticated electronic circuitry. Notwithstanding the fact that marquee and similar information providing devices have been used for a long time, no one has seen fit to provide anything better than the hand-installation of message elements. This is attained by the instant invention and at low cost, with rugged, reliable modules.

In one preferred form of the invention, a module is provided which can be grouped with like modules to provide a message. Each module has a number of elements arranged in rows and columns (optimally 5×7) with each element having a shutter thereon. Associated with each shutter is an electromagnet which can be selectively actuated from a remote source so as to preselect a grouping of elements which will either transmit or block light from illumination means positioned behind the grouped modules.

Other advantages and objects of the invention may be seen in the details of construction and operation set down in the ensuing specification.

DETAILED DESCRIPTION:

The invention is described in conjunction with the accompanying drawing, in which FIG. 1 is a perspective view, partially schematic and in fragmentary form of a system embodying teachings of the invention;

FIG. 2 is a front elevational view of an individual module constructed according to the invention;

FIG. 3 is a fragmentary perspective view of a slightly modified form of module from that depicted in FIG. 2 and shown in one condition of operation;

FIG. 4 is a view similar to FIG. 3 but showing the module element in the alternative form of operation, viz., with the shutter closed; and FIG. 5 is a fragmentary side elevational view, partially in section of a module element of the invention.

In the illustration given and with reference first to FIG. 1, the numeral 10 designates generally a portion of a sign assembly which is seen to be presenting the word "TODAY". As indicated previously, this could be part of a marquee or other sign and it will be seen that the assembly 10 is made up of a number of modules 11. In the illustration given, each module has a plurality of elements arranged in rows and columns which advantageously number 5 across and 7 down, thus adapting each module to present any desired piece of alphanumeric information.

An individual module 11 can be seen in FIG. 2 which includes a frame 12 and a plurality of shutter-equipped elements 13. The elements 13 in FIG. 2 are selectively actuated so as to form the "T" of the extreme left hand module 11 of FIG. 1. In FIG. 2, the modules 13' have their shutters pivoted open (as in the modified form illustrated in FIG. 3) while the shutters of the elements 13" are closed (as illustrated in FIG. 4). Thus, if an illuminating means (see the right hand portion of FIG. 5) is positioned behind the assembled modules, light can pass through the elements whose shutters are open. It will be appreciated that the reverse is possible as by selectively closing opaque shutters so that a dark image is presented against a light background.

In one specific embodiment of the invention, the shutter-equipped element is mounted on a frame or support generally designated 15. The support 15 includes a top or front strata 16 and a rear strata 17. The front strata may be made of a thin layer or aluminum sheeting of otherwise may be painted or silk-screened onto the back strata 17 which may be translucent sheet of plastic. Provided in the front strata 16 is an aperture 18.

Secured to the support 15 as by bolts (not shown) is a bracket 19 which supports an electromagnetic coil 20. The bracket 19 also pivotally supports as at 21, a flap or shutter 22. Additionally, the shutter 22 has secured thereto a permanent magnet element 23 (see also FIG. 4).

More particularly, the flaps or shutters 22 are each equipped with a permanent magnet of suitable strength, depending upon the size and weight of the flap—this in combination with the electromagnetic coil 20 which is also of suitable power and is positioned in close proximity so that the pole pieces, attached to both poles of the electromagnetic coil, will reach down to oppose the permanent magnet. Thus, there are two modes of operating the flaps. The first mode is where the coil or pole pieces exert an electromagnetic field of like polarity upon the poles of the permanent magnet, causing the permanent magnet to repulse the electromagnetic pole pieces, thereby rotating the entire flap and causing it to stay open as long as the electromagnetic field is in an energized state. Upon deenergization of the electromagnet, the repulsing force of the opposing poles is depleted, and the flap returned to its normal vertical position. The magnetic attraction of the permanent magnet to the pole pieces helps in closing the flap tightly over the aperture, thus preventing the spilling of unwanted lignt. The hinge brackets that support the flap are dimensionally designed to provide a stop for the raised, energized flap, thus assuring a uniform, predetermined angle for all energized flaps. This angle may be increased or decreased to stop the engergized flap at greater or smaller angles, depending upon the individual needs.

The alternative mode is a bi-stable orientation of the flaps in either the open or closed position, requiring energization only momentarily for each position. The permanent magnet latches magnetically to the pole piece in either the open or the closed positions, and is driven into the other position by reversing the polarity of the electric current to the electromagnet, thus reversing the electromagnetic field in relation to the permanent magnet's polarity.

For the purpose of providing any number of alpha-numeric characters on an internally illuminated plastic sign, each alpha-numeric matrix pattern of 25 (5×5) or 35 (7×5) flaps may be mounted onto an individual plastic sub and top strata, covered by a suitable dished and flanged cover providing a hermetically sealed sandwich. Each such sandwich element is equipped with a number of edge connector contacts 24 (see FIG. 2), one for each electromagnet of which there is one for each flap. Each such sandwich module's contact will mate with an equal number of contacts fastened within a track rail 25 mounted upon the illuminated plastic sign face, allowing permanent installation of one or several rows of alpha-numeric modules. Each module is equipped with required number of contacts, one for each coil contained therein plus one additional contact electrically common to all and serviced by the lead 26.

The total number of conductors of cable (as at 27)—that connects the display with the input controls 28 (which may be located within any reasonable distance relative to the display) is 35 plus 1 common for each of the number of elements within a given system. An elementary input device consists of an enclosure which is equipped with a slot 29 that will accept coded plastic cards 30, one for each required character, and a series of pushbutton switches 31, one for each of the common leads returning from each of the alpha-numeric-modulators, and numbered according to the element's position on the display. Metallic or optical codes on the plastic card complete the required circuits to a selected number of the 35 wires in the cable to energize those flaps as are needed to form the character. Closing of the pushbutton switches energizes the flaps of the alpha-numeric module thus addressed. Alternatively, a sophisticated input method can be utilized employing an electric typewriter type keyboard with the further refinement being the addition of a memory system allowing the automatic display of typed messages in sequential order.

I claim:

1. A module for presenting alpha-numeric information comprising a frame, a plurality of shutter elements mounted on said frame and arranged in rows and columns to define an alpha-numeric module, a plurality of said modules being arranged in horizontal side-by-side relation with the shutters thereof positioned on the front of each module, illuminating means positioned behind the module arrangement, and means associated with each element for pivoting the shutter thereof to provide a part of a preselected piece of information, said means including an electromagnet, a permanent magnet on each shutter and actuating means remote from said module for actuating said electromagnet, each electromagnet being mounted on the front of said frame adjacent its associated shutter and equipped with pole-pieces arranged in close proximity to the permanent magnet of said associated shutter to oppose the magnetic field of said permanent magnet and pivot said associated shutter.

2. The structure of claim 1 in which each row has at least 5 elements therein.

3. The structure of claim 2 in which each column has 7 elements therein.

* * * * *